US005186421A

United States Patent [19]

Caccomo

[11] Patent Number: 5,186,421

[45] Date of Patent: Feb. 16, 1993

[54] RAIL FINDER

[76] Inventor: Paul G. Caccomo, 18 Crossway Rd., Beacon, N.Y. 12508

[21] Appl. No.: 661,178

[22] Filed: Feb. 27, 1991

[51] Int. Cl.[5] ..... B61L 23/04

[52] U.S. Cl. ..... 246/118; 14/49

[58] Field of Search ..... 246/118, 119; 191/9; 14/36–42, 49; 200/566

[56] References Cited

U.S. PATENT DOCUMENTS

| | | | |
|---|---|---|---|
| 198,449 | 12/1877 | Buchanan | 14/49 |
| 343,322 | 6/1886 | Johnson | 14/49 |
| 405,042 | 6/1889 | Long | 246/118 X |
| 884,947 | 4/1908 | Ogle | 246/119 |
| 2,366,848 | 1/1945 | Ferri | 14/36 X |
| 2,528,064 | 10/1950 | Logan, Jr. et al. | 246/118 |
| 2,575,815 | 11/1951 | Jefferson | 246/118 |
| 2,875,325 | 2/1959 | Koenig | 246/118 |

OTHER PUBLICATIONS

General Railway Signal, "Typical Circuits and Maintenance Suggestions for Model 7J Switch Circuit Control," Jun. 1979.

*Primary Examiner*—Michael S. Huppert
*Assistant Examiner*—Scott L. Lowe
*Attorney, Agent, or Firm*—Joseph B. Taphorn

[57] ABSTRACT

A rail finder for railroad bridges is compactly and uniquely designed to minimize false signals and decrease replacement and maintenance costs. A weighted lever mounted on switch-box rotatable shaft that is perpendicularly disposed with respect to the rail, has an offset portion directly engageable by a horizontal plate mounted on the inner surface of a rail on a bridge. The plate holds the lever in a horizontal position in the down position of the bride. When the bridge raises, the weighted lever follows the plate and rotates the switch box shaft to where cams move switchable elements from a set of contacts. The contacts of the set are in circuit with green lights permitting train passage when the cams are out of contact with the switchable elements. The compact arrangements allow a pair of rail finders to be mounted side-by-side within the gauge and thus out of the path of loose or low third-rail shoes of electrically-powered trains.

8 Claims, 5 Drawing Sheets

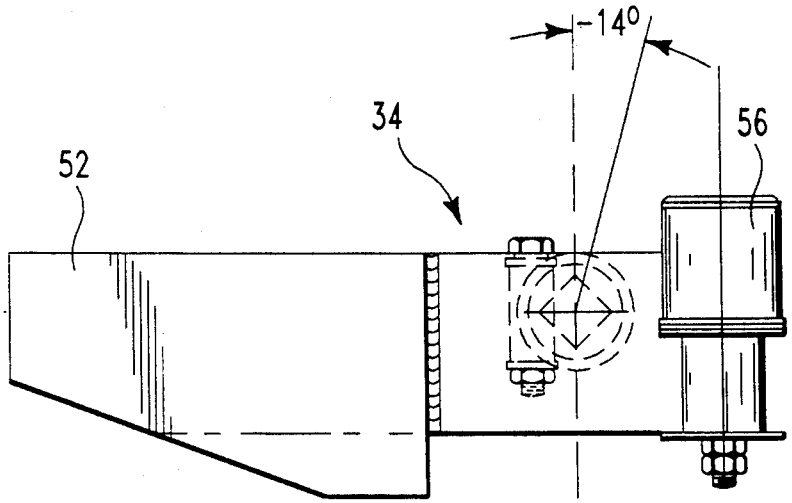
FIG. 3
FIG. 4
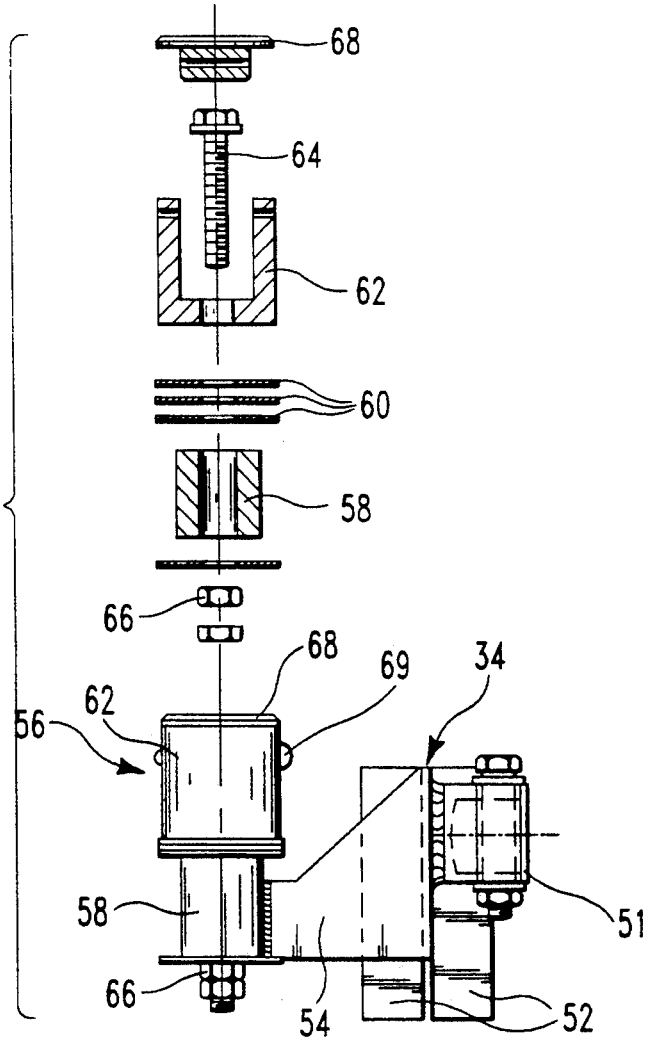

RAIL FINDER

BACKGROUND OF THE INVENTION

1. Field of the Invention

This invention relates to railroad drawbridges, and more particularly to rail finders for such drawbridges.

2. Prior Art

Rail finders indicate when the rails of a raised or drawn aside railroad drawbridge have returned to their operative position in which they are aligned with the rails of the tracks leading to and from the railroad bridge. Today's railfinders incorporate switch boxes having a rotary shaft. The switch-box rotary shaft is rotated through an extended linkage and lever arrangement actuated by the raising and lowering of the adjacent rail of the bridge. A weighted lever pivotally mounted outside the tracks but extending underneath the adjacent rail, is engaged by the adjacent rail when a bridge descends and held in a horizontal position. The weighted lever is adjustably fixed at a midpoint to a shaft extending parallel to the rail and adjustably mounting a second lever extending generally horizontally away from the tracks. As a bridge is opened and the weighted lever follows its rising rail, the second lever swings downward to pull on one end of a turnbuckle link whose other end is connected to a lever adjustably depending from the rotatable shaft of a switch box.

The extended linkage, unfortunately, is the source of many false signals. The lost motion inherent in such an extended linkage enables its parts to be freely vibrated, not only from the movement of the heavy bridge parts but also from the passage of the trains. These vibrations shake the switch box with the result that contacts therein are closed or opened and provide false signals of the bridge's condition.

The extended linkage is also difficult and expensive to install; in fact a high level of skill is required. Not only must the parts be connected so as to send the correct signals for all conditions of the bridge, but the parts must also be so positioned as to operate under all weather conditions. For example, operation in or under snow and ice must be facilitated. Expansion and contraction due to the extremes of heat and cold must be accommodated.

The problems of the extended linkage are compounded by the switch box locations mandated by the extended linkage. Because of the length of the extended linkage, the switch boxes (and the extended linkage) must be mounted outside the tracks. This places them in the path of frequently hanging third rail shoes of electrically powered trains. Since the switch or circuit controlling box is of a cast metal, it usually cannot withstand even one strike from a a shoe. Even the extended linkage levers and arms receive damage due to the force of some hits. Even if the very expensive switch box, and/or elements of the extended linkage need not be replaced, expensive internal repair and/or adjustment due to the strikes or blows to the circuit boxes by the hanging shoes may still be necessary. Of course, even more crucial, is the impairment of rail traffic, particulary morning commuter traffic.

SUMMARY OF THE INVENTION

Accordingly, it is an object of the invention to provide a rail finder which is less interruptive of rail traffic.

Another object of the invention is to provide a rail finder which provides fewer false signals.

Still another object of the invention is to provide a rail finder which is simple and easy and inexpensive of installation.

Yet another object of the invention is to provide a rail finder wherein the switch box can be located outside of the path of hanging shoes of electrically powered trains.

A further object of the invention is to provide a rail finder having reduced maintenance costs.

A still further object of the invention is to provide a rail finder that is more reliable in operation, particularly under varying weather conditions.

A yet further object of the invention is to provide a reliable rail finder that is simple and inexpensive of construction and operation.

These objects of the invention are achieved through a rail finder having a shortened linkage, and a linkage that enables the switch box, and the switch box for the rail finder of the associated track rail, to be located within the track gauge. A weighted lever is adjustably fixed at a midpoint to the shaft of the conventional switch box which is situated close to the rail and so that its shaft is perpendicular to the track rail. The unweighted end of the lever is formed with an offset portion mounting an electrically insulating and resilient contact assembly. The contact assembly is positioned to be engaged by a horizontal plate mounted on the inner side of the vertically movable bridge rail. As a bridge opens, the contact assembly and the lever mounting it follow the rising rail and plate for a short distance under the influence of the weight at the other end of the lever and rotate the shaft of the switch to generate the signals indicative of the opened condition of the bridge. Conversely, as the bridge descends to closed position, the plate on the rail engages the contact assembly on the weighted lever arm to rotate the switch box shaft and open and/or close appropriate contacts within the switch box generating signals indicative of the closed condition of the bridge.

Mounting the switch boxes within the gauge still leaves the switch boxes subject to vibration. The vibration causes wear of the switchable contacts within the switch box, and hence high replacement and other maintenance costs. In the standard switch box setup, cams are fully pressed against the heel roller bearings of the movable switch elements, in the down position of the bridge. (When the switch box shaft was rotated upon raising of the railroad bridge, the cams were turned away from the roller, reducing pressure on the movable switch elements and allowing opening of the front contacts operative in the closed condition to indicate the down position of the bridge, and allowing closing of the rear contacts which could be operative in the closed condition to indicate the open position of the bridge.) In the down position of the bridge, the rails are of course subject to rail traffic, and train movement agitates, with each wheel, the switch box. The agitation or vibration causes movement of the cams with respect to the switch element roller bearings, and of the roller bearings with respect to the switch elements, resulting in extreme mechanical wear and high maintenance costs.

Applicant has discovered that the wear and tear in switch boxes can be signifcantly reduced. This by rearranging the operative relationships between the bridge and the switch box components so that the trains do not vibrate the cams when they are in contact with the switch element rollers. Applicant accomplishes this by arranging the cams on the switch box shaft so that they do not engage the switch element rollers in the down or train passing condition of the bridge. Thus the cams are brought into contact with rollers of the movable switch elements only when the bridge is open and trains are not passing; a time of little vibration and hence of minimal wear and tear.

BRIEF DESCRIPTION OF THE DRAWINGS

These and other objects, features and advantages of the invention will become apparent from a reading of the following description when considered with the accompaning drawings wherein:

FIG. 3 is a side view of the weighted lever shown in FIG. 2;

FIG. 4 is a right hand end view of the lever of FIG. 3 and including an exploded view of the contact assembly at the end of the weighted lever;

DETAILED DESCRIPTION OF A SPECIFIC EMBODIMENT

Figure 1:
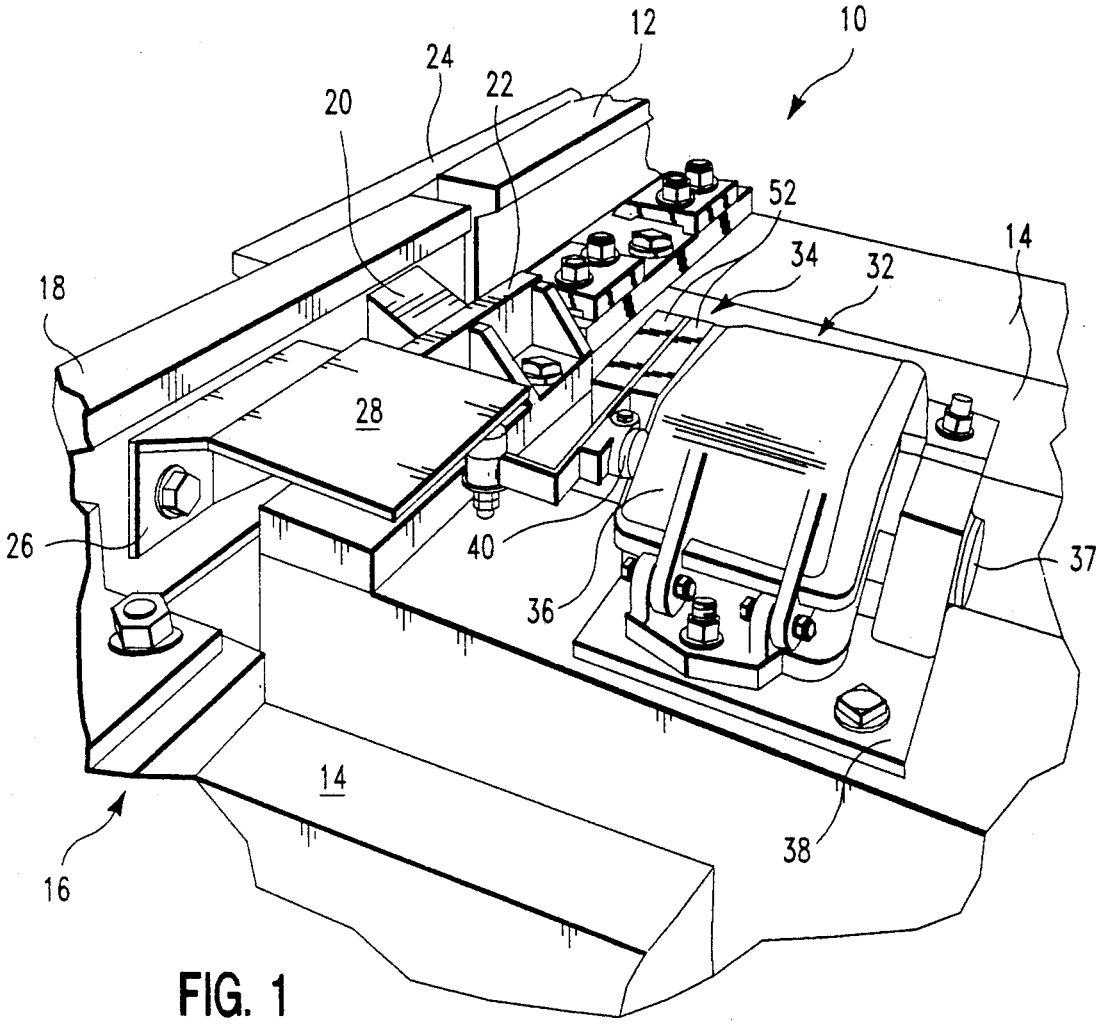
FIG. 1 is a view in perspective of an installation of one of the two rail finders that would be mounted at the approach to a railroad bridge.
Figure 2:
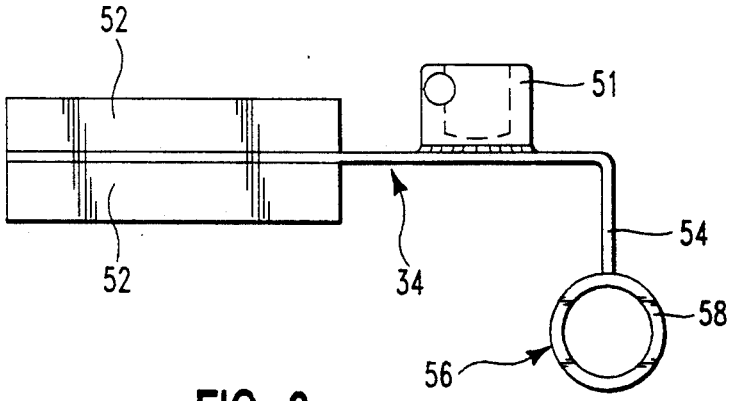
FIG. 2 is a top view of the weighted lever of the rail finder shown in FIG. 1.

Referring now to the drawings, there is shown in FIG. 1 the bridge approach of a track generally indicated by the number 10 and having a right hand rail 12, for an oncoming train (not shown). The rail 12 is secured to conventional wooden ties 14 of the track by normal spike and plate arrangements. Of course, a left hand rail for the track exists too.

FIG. 1 also shows the right hand end of a vertically raisable bridge generally indicated by the number 16, for the track 10. Thus the bridge mounts in conventional fashion a rail 18 which meets the track rail 12. The free end of the vertically movable rail 18 is held aligned in its down position with the end of the rail 12 by cooperating cam surfaces on a block 20 affixed to its inside surface and a block 22 suitably spiked to the ties 14 and by a bar 24 bolted to the other and outer side of the rail 12 and extending beyond its end.

Figure 5:
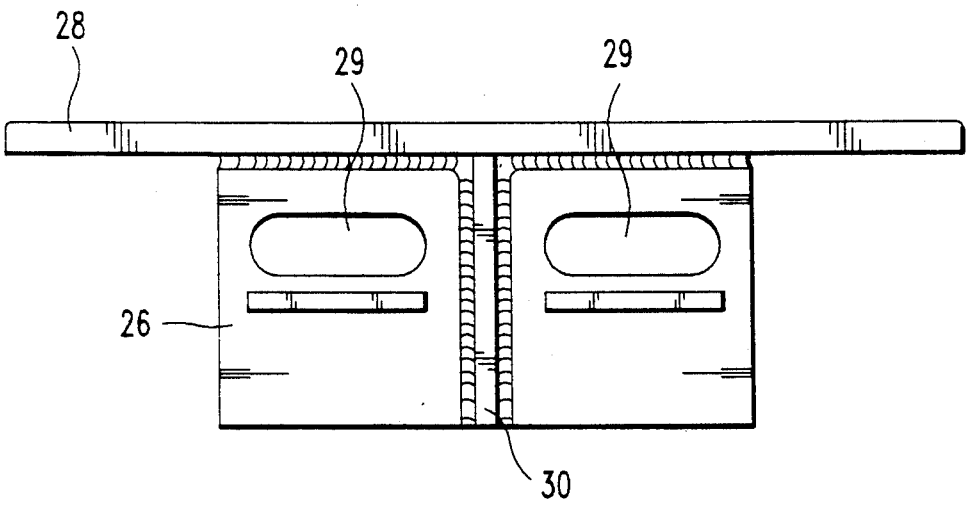
FIG. 5 is side view of a horizontal plate shown in FIG. 1 as bolted to the inside of a bridge rail which rises when the bridge is opened.
Figure 6:
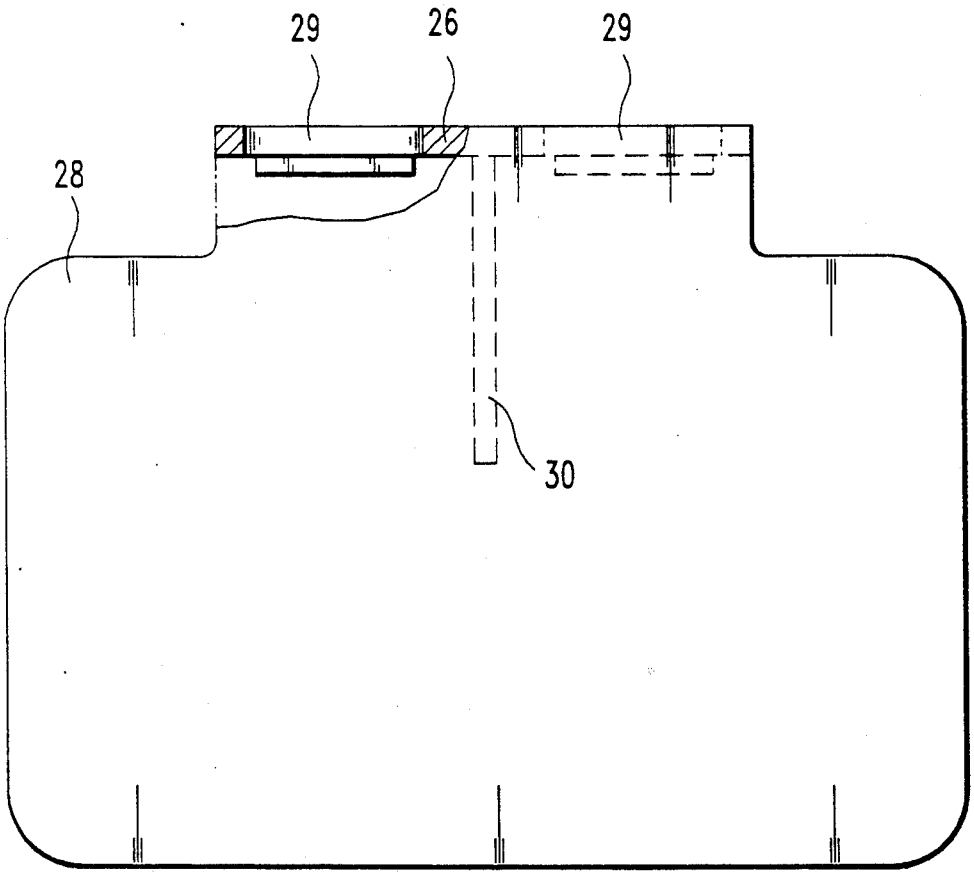
FIG. 6 is a top view of the plate shown in FIG. 5.
Figure 7:
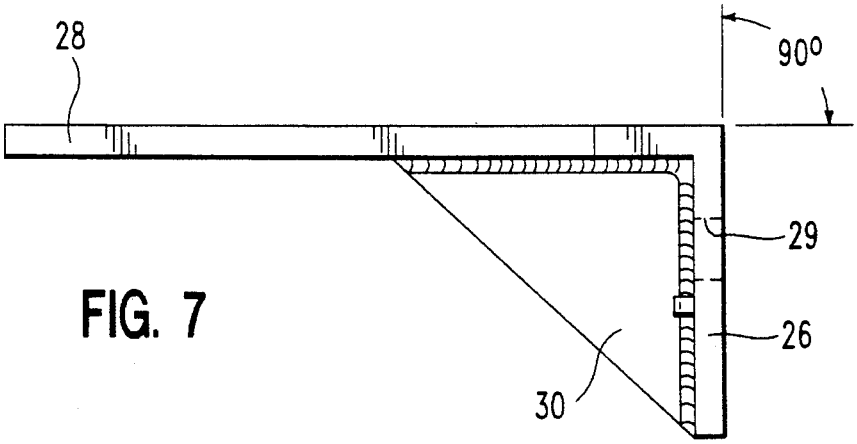
FIG. 7 is a view of the right hand end of the plate shown in FIGS. 5 and 6.

Also mounted on the inside of the rail 18 as by bolting through a downturned portion 26, is a horizontal plate 28 welded to the downturned portion 26. As best seen in FIGS. 5–7, the horizontal plate 28 is generally rectangular and of larger dimension than the downturned portion 26. Suitable oblong holes 29 through the downturned portion 26 facilitate adjustment of the plate with respect to other components of the rail finder. A triangularly shaped bracket 30 may be welded to the side of the downturned portion 26 and the underside of the horizontal plate 28 to form a very rigid structure.

The horizontal plate 28 constitutes the actuating element of the rail finder.

The other components of the rail finder include a switch box generally indicated by the numeral 32 and a weighted lever generally indicated by the numeral 34. The switch box 32 may be of conventional construction, but as will be explained later, has its constituents newly arranged.

Figure 8:
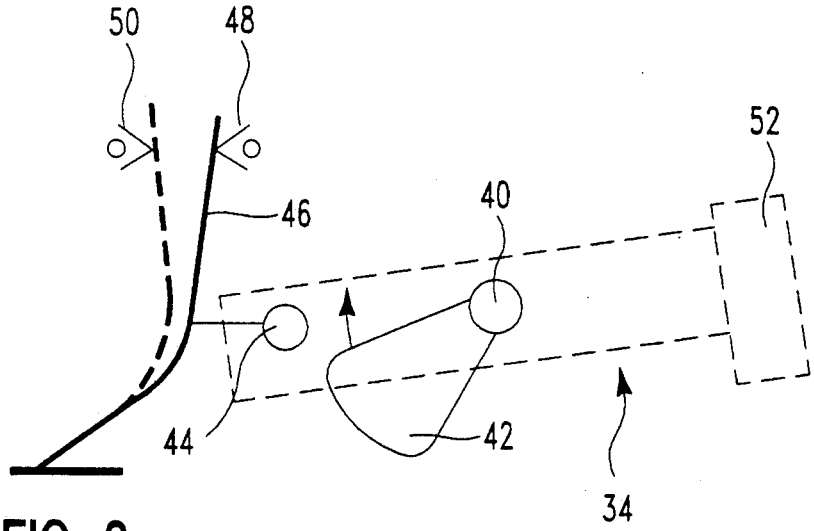
FIG. 8 is a schematic of a switch box's components including the rotary shaft, cams, movable switch elements and their rollers, and front and back switch contacts.

The switch box 32, as best seen in FIG. 1, is a generally rectangularly box 36 that is bolted over a plate 38 to the wooden ties 14 to secure it near the rails 12 and 18. It includes a hinged top to protect and for gaining access to its internal constituents. A rotable shaft 40 is mounted through the box 36 so as to be perpendicular to the rail 12, and adjustably mounts exteriorily the weighted lever 34, while mounting, interiorily, cams 42 (FIG. 8). The cams 42, while normally (down position of the bridge) not engaging heel roller bearings 44 on movable biased switch elements 46, do engage the heel roller bearings 44 on rotation of the shaft 40 to move the switch elements 46 out of engagement with the rear contacts 48 and into engagement with the front contacts 50.

Rotation of the shaft 40 is normally effected through the weighted lever 34. The weighted lever 34 is adjustably secured, via a bolt-tightened cup 51 welded to it at a midpoint (see FIGS. 1–4), to an end of the shaft 40. As seen in FIG. 1, the right hand or rearward end of the lever 34 is provided with weights 52 which have the effect of biasing the lever 34 clockwise as seen in FIG. 8 until the weights 52 rest on the wooden ties 14. The other end of the lever is formed with a right-turned portion 54 which mounts at its free end a contact assembly 56. The location of the switch box 32 and the dimensions of the lever 34 and its right-turned portion are such that the contact assembly 56 rests against the underside of the horizontal plate 28 in the down position of the bridge 16.

As best seen in FIG. 4, the contact assembly 56 includes a cylinder 58 which is welded to the end of the right-turned portion 54 of the weighted lever 34. On top of the cylinder 58 are placed a number of washers or disks 60 to effect desired adjustment of the upper end of the contact assembly as will soon become apparent. Above the washers or disks 60 is an upwardly open cup-like housing 62 of a resilient and electrrically insulating material like nylon and which receives and seats the head of a bolt 64 which extends downwardly through openings in the housing, washers or disks, cylinder and a bottom washer reacting against a nut 66 and a locking nut, to hold the contact assembly together and in place. The cup-like housing receives at its upper end the depending center portion of a wear resistant cap 68. Suitable aperatures in the housing and in the cap depending portion accommodate the insertion of a cotter pin 69 to replaceably hold the wearable cap 68 in place.

The wear resistant cap 68 also functions as a cap facilitating test of the rail finder without requiring raising of the bridge. Thus the cap is of a thickness which when removed allows operation of the railfinder to where it should effect the bridge-open-condition circuits. If all is well, the cap is replaced and normal track operation continued. If all is not well, then further checking and maintenance operations are initiated.

The switch box 32 may mount a conventional centering device 37 which contains two coil springs which work on levers affixed to the shaft 40 to bias the shaft 40 to a position indicating an open condition of the bridge. Thus should the lever 34 breakoff, an appropriate stop signal would be generated through rotation of the shaft 40.

In installation, the horizontal plate 28 would be bolted via its downturned portion 26 to the inside of the free end of the rail 18 on the bridge 16. The weighted lever 34 would have been placed on the shaft 40 of the switch box 32, and the switch box 32 and its plate 38 would be so positioned on the wooden ties 14 of the track as to locate the contact assembly 56 on the end of the right-turned portion 54 of the weighted lever 34 under the center of the horizontal plate 28 affixed to the the bridge rail 18, and then bolted to the wooden ties 14. Centering may be abetted by sliding the plate 28 on its rail bolts via the oblong holes 29.

Precise adjustments of the rail finder would be begun by adding or subtracting washers or disks 60 to or from the contact assembly 56 under the horizontal plate 28 so as to leave the weighted lever arm essentially horizontal in the lowered or closed position of the bridge. Thereafter the position of the switch box shaft 40 with respect to the weighted lever 34 would be adjusted so that the cams 42 in the switch box 40 are a) out of contact with the heel roller bearings 44 on the switch elements 46, leaving the later in contact with the rear electrical contacts 48, but b) engage the bearings 44 on rotation of the shaft 40 upon raising of the bridge 16 as the contact assembly 56 follows the horizontal plate 28 under the influence of the weights 52 on the lever 34, moving the switch elements 46 from the rear electrical contacts 48, and to the front electrical contacts 50 if desired.

In operation, in the down or closed position of the bridge 16, the horizontal plate 28 on the bridge rail 18 would be engaging the cap 68 of the contact assembly 56 to hold the weighted lever 34 in its generally horizontal position in which it holds the shaft 40 affixed to it in a position in which the cams 42 are clear of the bearing rollers 44 and the moveable biased switch elements are in engagement with the rear electrical contacts 48. The electrical contacts 48 are in circuits which reflect the down or closed condition of the bridge in which the rails are seated, and energize green lights signalling that the train may proceed if all else is in order.

Figure 9:
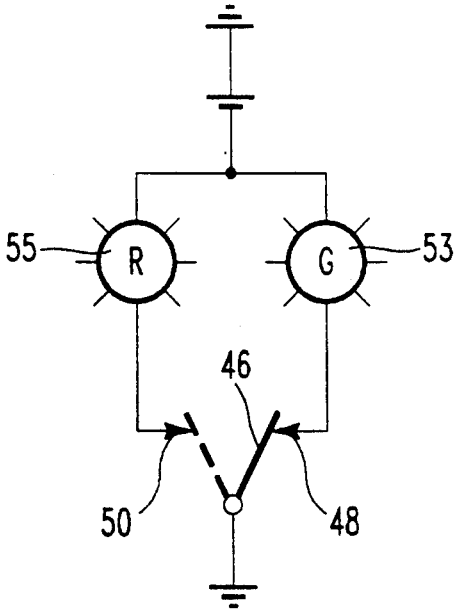
FIG. 9 is a schematic circuit drawing including the front and back switch contacts.

Upon opening of the bridge 16, the rail 18 would be rising and taking with it the horizontal plate 28. The contact assembly 56 would be following up the horizontal plate 28 movement under the influence of the weights 52 on the lever 34, with result that the switch box shaft 40 would be rotated clockwise as seen in FIG. 8. The clockwise rotation of the shaft 40 would bring the cams 42 into engagement with the heel bearings 44 to move the biased switch elements 46 out of engagement with the rear contacts 48 and into engagement with the front contacts 50. Disengagement of the switch elements 46 from the rear contracts 48 would open the circuits to the green lights 53 (FIG. 9) to extinguish them, while engagement with the front contacts 50 could complete circuits through red stop lights 55 warning trains not to procede on account of the open condition of the bridge 16. (Circuits may not need to be completed through the front contacts as some railway signalling systems employ a relay coil in the green light circuit which closes the red-light circuit to energize it on deenergization of the green-light circuit.) The cams 42 have extended high points so that continued following of the rising bridge rail by the weighted lever 34 maintains the switch elements 46 in engagement with the front contacts 50. Movement of the weighted lever 34 will stop when the weights 52 engage the wooden ties 14.

Upon lowering the bridge, the horizontal plate 28 picks up the contact assembly at the point where rotation of the lever 34 was stopped by engagement of the weights 52 with the wooden ties 14. Continue downward movement of the bridge 16 and plate 28 rotates the lever 34 hence the shaft 40 and cams 42 to where the cams disengage from the heel bearings 44 as the bridge closes. Thereupon the circuit through the contacts 50 and red stop lights are broken and circuits thought the contacts 48 and the green go lights are completed.

It will be appreciated that applicant has invented a rail finder which is more reliable in operation than existing ones and which has lower maintenance costs. The simple, compact linkage between the bridge rail and the switch box resulting from the new orientation and placement of the switch box, eliminates lost motion connections and attendant wear and tear problems. Reliability introduces less false signals and more timely railroad services. Destruction of switch boxes by the hanging shoes of electrical trains is eliminated. Installation is simple and easier, enabling employment of less skilled persons. Wear and tear on cams and switch elements and contacts is reduced because the cams are not in contact with the switch elements as the trains are crossing the bridge and creating enormous vibrations with each passing wheel.

Figure 10:
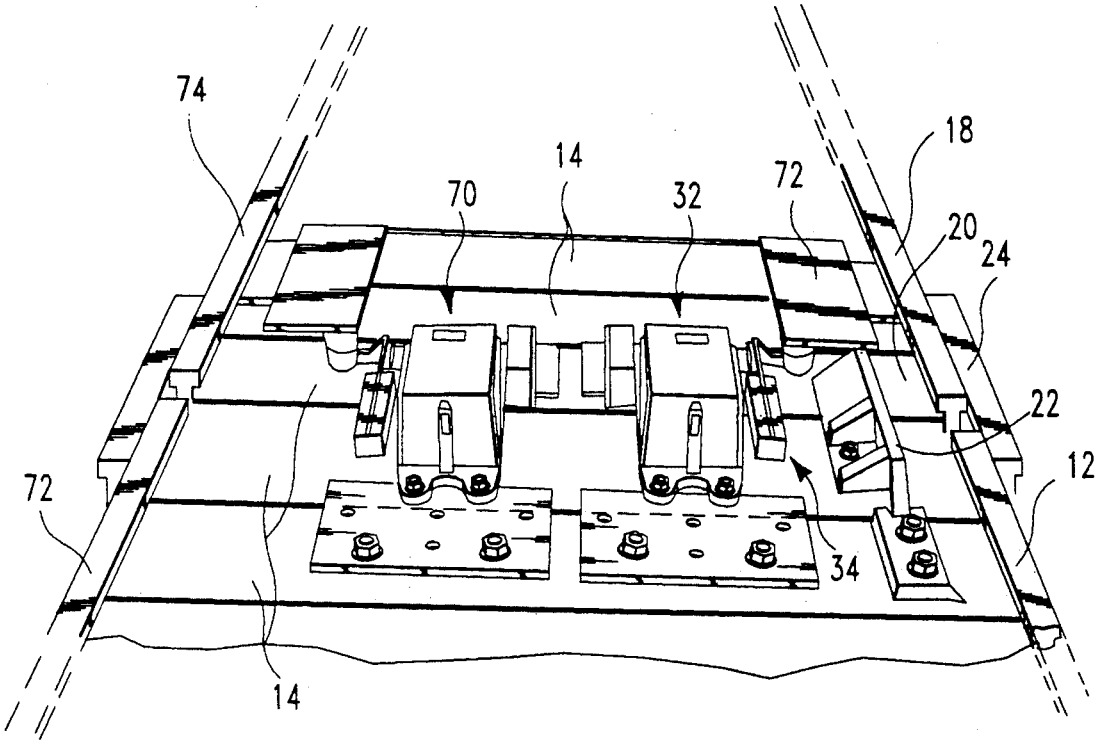
FIG. 10 is a view in perspective showing two rail finders mounted side-by-side at the approach to a railroad bridge.

As shown in FIG. 10, two rail finders are normally employed in side by side relationship in the interests extra safety. A second switch box 70 has an orientation and placement with respect to the second track rail 72 and bridge rail 74 that is the mirror image of that for the switch box 32 and the first track rail 12 and the bridge rail 18. Applicant's compact structure enables both rail finders to be placed within the gauge, and hence out of the path of hanging shoes of electrically powered trains.

While applicant has shown a preferred embodiment of the invention, it will be apparent to those skilled in the art that other devices employing principles of the invention may be readily made. Accordingly it is intended that the patent be limited only by the spirit and scope of the appended claims.

What is claimed is:

1. In rail finder for use with a railroad bridge having a rail and movable between raised and closed positions, a switch box having a rotatable shaft mounted so that the shaft is perpendicular to the rail, a lever fixed to the shaft and extending parallel to the rail, and means on the lever for direct engagement in the closed position of the bridge by a part fixed to the rail on the bridge and for being disconnected therefrom in the raised position of the bridge, wherein the means on the lever for direct engagement comprises a contact assembly including an electrically insulating material.

2. A rail finder according to claim 1, wherein the contact assembly includes a wear resistant cap above the insulating material.

3. A rail finder according to claim 2, wherein the cap is readily removable to facilitate testing the rail finder without raising the bridge.

4. In a rail finder for use with a railroad bridge having a rail and movable between raised and closed positions, a switch box having a rotatable shaft mounted so that the shaft is perpendicular to the rail, a lever fixed to the shaft and extending parallel to the rail, and means on the lever for direct engagement in the closed position of the bridge by a part fixed to the rail on the bridge and for being disconnected therefrom in the raised position of the bridge, wherein the means on the lever for direct engagement comprises ac contact assembly wherein its height is adjusted by adding or eliminating disks.

5. In a rail finder for use with a railroad bridge having a rail and movable between raised and closed positions, a switch box having a rotatable shaft mounted so that the shaft is perpendicular to the rail, a lever fixed to the shaft and extending parallel to the rail, and means on the lever for direct engagement in closed position of the bridge by a part fixed to the rail on the bridge and for being disconnected therefrom in the raised position of the bridge, wherein the means on the lever for direct engagement comprises a contact assembly including a resilient material.

6. In a rail finder for use with a railroad bridge having a rail and movable between raised and closed positions, a switch box having a rotatable shaft mounted so that the shaft is perpendicular to the rail, a lever fixed to the shaft and extending parallel to the rail, and means on the lever for direct engagement in the closed position of the bridge by a part fixed to the rail on the bridge and for being disconnected therefrom in the raised position of the bridge, wherein the means on the lever for direct engagement comprises a contact assembly including a vertical cylinder affixed to the end of the lever.

7. A rail finder according to claim 6, wherein the contact assembly includes an electrical insulating and resilient material above the cylinder and a wear resistant cap above the resilient material.

8. In a rail finder for use with a railroad bridge having a rail and movable between raised and closed positions, a switch box having a rotatable shaft mounted so that the shaft is perpendicular to the rail, a lever fixed to the shaft and extending parallel to the rail, and means on the lever for direct engagement in the closed position of the bridge by a part fixed to the rail on the bridge and for being disconnected therefrom in the raised position of the bridge, wherein the lever has an offset portion at one end bearing the means for direct engagement by a part on the bridge, and a weight at the other end for biasing the lever for the direct engagement.

* * * * *